United States Patent [19]

Nishigaki et al.

[11] Patent Number: 5,064,183

[45] Date of Patent: Nov. 12, 1991

[54] SUCTION TYPE SHEET FEEDING DEVICE

[75] Inventors: Hideo Nishigaki; Shigeyuki Hayashi, both of Nagoya, Japan

[73] Assignee: Brother Kogyo Kabushiki Kaisha, Nagoya, Japan

[21] Appl. No.: 581,058

[22] Filed: Sep. 12, 1990

[30] Foreign Application Priority Data

Oct. 31, 1989 [JP] Japan ..... 1-127790[U]
Oct. 31, 1989 [JP] Japan ..... 1-283480
Oct. 31, 1989 [JP] Japan ..... 1-285323

[51] Int. Cl.[5] ..... B65H 3/08

[52] U.S. Cl. ..... 271/10; 271/107; 294/64.1

[58] Field of Search ..... 271/90, 98, 103, 106, 271/107, 108, 10; 294/64.1

[56] References Cited

U.S. PATENT DOCUMENTS 1,367,528 2/1921 Anderson ..... 271/107
2,163,441 6/1939 Von Hofe ..... 294/64.1
2,840,270 6/1958 Gore ..... 221/211
3,837,638 9/1974 Anderson ..... 271/98 X
4,351,518 9/1982 Stievenart ..... 271/90
4,355,797 10/1982 Graef ..... 271/107 X
4,513,957 4/1985 Schaefer ..... 271/90
5,005,818 4/1991 Hayashi ..... 271/107

FOREIGN PATENT DOCUMENTS 3713037 10/1988 Fed. Rep. of Germany ..... 271/90
1525698 9/1978 United Kingdom ..... 271/107

*Primary Examiner*—Richard A. Schacher
*Attorney, Agent, or Firm*—Oliff & Berridge

[57] ABSTRACT

A suction type sheet feeding device which attracts an uppermost sheet of a sheet stack to a suction cup by a negative pressure, and transfers the attracted sheet to a predetermined position. For producing the negative pressure, a bellows or accordionlike enclosure is employed. In accordance with axial shrinkage and expansion of the bellows, the negative pressure is produced. The bellows is in fluid communication with the suction cup. Improvement is also made on a cleaning arrangement for cleaning the suction cup, and on the structure of the suction cup unit.

9 Claims, 7 Drawing Sheets

SUCTION TYPE SHEET FEEDING DEVICE

BACKGROUND OF THE INVENTION

The present invention relates to a suction type sheet feeding device, and more particularly, to a type thereof particularly available for an image recording apparatus.

In a conventional image recording apparatus, a stack of image recording sheets such as developer sheets are accommodated in a sheet cassette, and an uppermost sheet is separated from the remaining sheet stack and fed to a predetermined position such as a sheet path by the sheet feeding mechanism. Conventionally, a roller is used for feeding an uppermost sheet of the sheet stack to the sheet path. The roller pressingly urges the uppermost sheet, so that the sheet surface may be damaged by the roller. Therefore, a suction type sheet feeding device has been proposed. In the suction type sheet feeding device, the uppermost sheet is attracted to a suction cup by bringing the suction cup into intimate contact with the uppermost sheet and applying a negative pressure within the suction cup. Because of the negative pressure, the uppermost sheet is lifted upon lifting motion of the suction foot, and is fed to a proper location such as a pressure developing unit through the sheet feed path.

In such conventional suction type sheet feeding device, a negative pressure generating means including a cylinder and a piston slidably disposed therein is provided, and the negative pressure generating means is in communication with suction cup via a joint member and a hose.

With such conventional arrangement, however, a sealing member such as an O-ring is required so as to provide hermetic construction between a cylinder wall and the piston. Further, relatively large frictional resistance may be provided in the sliding movement of the piston relative to the cylinder wall. In this respect, precise machining to the cylinder wall is required, thereby increasing production costs. Furthermore, in the conventional piston/cylinder arrangement, only one end of the cylinder is connectable to the suction cup for introducing the negative pressure thereto, and therefore, if a plurality of suction cups are intended to be connected to the negative pressure generating means, an intricate joint member is required. Thus, the resultant device becomes increasing costly.

In another aspect, since the suction type sheet feeding means produces the negative pressure, dust and other foreign substances at or around a sheet cassette may be deposits of these materials on the suction cup. Due to the deposition, the sheet attracting performance may be lowered, and mechanical breakdowns may occur. In this standpoint, cleaning to the suction cup has been carried out at every sheet feeding operation. However, the entire sheet feeding period may be prolonged, and therefore, image recording operation requires prolonged time period due to the existence of dead time.

SUMMARY OF THE INVENTION

The present invention has been made to overcome the above described drawbacks and deficiencies, and it is an object of the invention to provide an improved suction type sheet feeding device in which stabilized pressure reduction is achievable with simple construction and at low cost in a negative pressure generation unit without any requirement of high dimensional accuracy, and without any mechanical sliding motion.

Another object of the invention is to provide a suction type sheet feeding device in which cleaning to suction cup unit is efficiently carried out with minimizing dead time for inherent operation of an image recording apparatus.

Still another object of the invention is to provide an improved suction cup unit capable of providing stabilized sheet attraction in the sheet feeding device.

These and other objects of the invention are attained by providing a sheet feeding device for feeding an uppermost sheet of a sheet stack to a predetermined position, comprising: at least one suction cup unit movable toward and away from the uppermost sheet for attracting the uppermost sheet, moving means mounting thereon the suction cup for moving the suction cup toward the uppermost sheet and toward the predetermined position, and a negative pressure generating unit connected to the suction cup unit for generating a negative pressure within the suction cup, the negative pressure generation unit comprising a bellows shrinkable and expandable in its axial direction, and drive means for selectively providing the shrinkage and expansion of the bellows.

In one embodiment of this invention, the sheet feeding device further includes cleaning means for cleaning the suction cup, and control means connected to the moving means and the drive means for cleaning the suction cup after every predetermined number of sheet feeding operations given by the moving means and the drive means. The control means includes a microprocessor provided with a memory for storing therein numbers of sheets fed through a sheet feed path.

Further, the suction cup unit includes a flexible suction disc adapted for contacting the uppermost sheet, the suction disc having a frusto-conical configuration with increasing its inner diameter toward its tip end, a suction pipe formed with a suction hole and a suction port at a tip end of the suction hole, the suction pipe having one end portion fitted with the suction disc, and another end portion. The one end portion of the suction pipe has a free end face defining a suction face and formed with at least one groove whose one end is opened to the suction port and whose another end is opened to an outer circumference of the suction pipe.

DETAILED DESCRIPTION OF THE PREFERRED EMBODIMENTS

A fundamental construction of a suction type feeding device according to the present invention will first be described with reference to FIG. 1.

Figure 1:
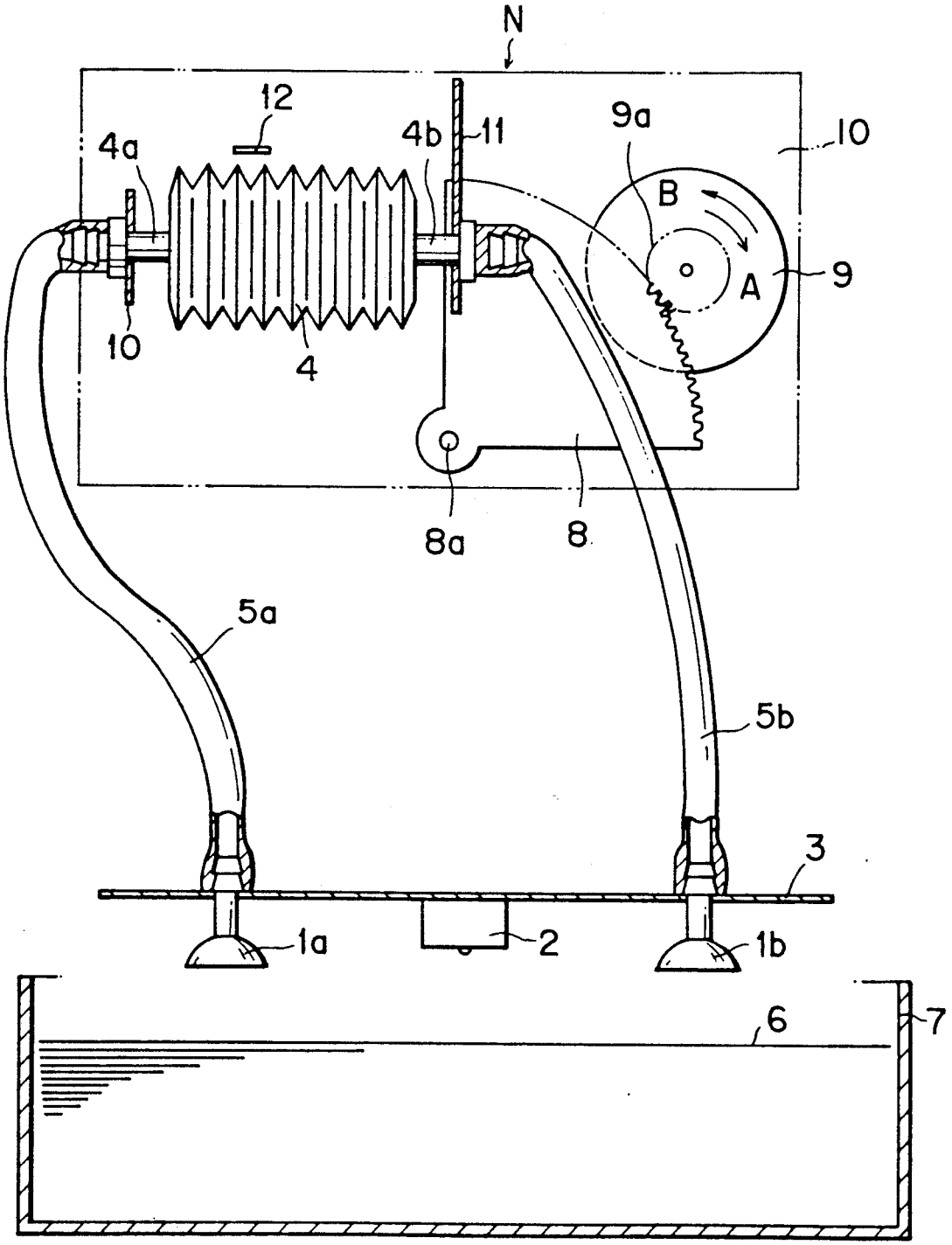
FIG. 1 is a schematic view showing a fundamental arrangement of a suction type sheet feeding device according to the present invention.

As shown in FIG. 1, the suction type sheet feeding device includes a negative pressure generating unit N having a bellows 4. The bellows 4 has one end connected to a first joint 4*a*, and has another end connected to a second joint 4*b*. A stationary bracket 10 is provided for fixedly supporting the first joint 4*a*, and a movable bracket 11 is provided for fixedly supporting the second joint 4*b*. A sector gear 8 is provided rotatable about a pin 8*a* fixed to the stationary bracket 10, and is meshedly engaged with a drive gear 9*a* of a drive motor 9. The movable bracket 11 is operably connected to the sector gear 8. Therefore, when the drive motor 9 is rotated in one direction, for example in a direction indicated by an arrow A in FIG. 1, movable bracket 11 is moved in a first direction so that the bellows 4 is shrunk in its axial direction. On the other hand, when the drive motor 9 is rotated in opposite direction, a direction indicated by an arrow B in FIG. 1, the movable bracket 11 is moved in a second direction so that the bellows 4 is axially expanded. On the stationary bracket 10, a stop member 12 is protruded on which the movable bracket 11 is abuttable.

Suction cups 1*a* and 1*b* are supported on a movable member 3 provided movable at a position above a sheet cassette 7 in which a stack of cut sheets 6 are accommodated. The suction cup 1*a* is connected to the first joint 4*a* through a first flexible tubular member 5*a*, and the suction cup 1*b* is connected to the second joint 4*b* through a second flexible tubular member 5*b*. Further, a sheet sensor 2 is provided on the movable member 3. In accordance with a decent movement of the movable member 3, the sheet sensor 2 is brought into contact with an uppermost sheet 6 to provide ON state of the sensor 2. The movable member 3 is adapted for moving the suction cups 1*a* and 1*b* toward and away from the uppermost sheet, and for delivering the uppermost sheet sucked by the suction cups toward a predetermined sheet feed path (not shown).

With this fundamental structure, at an initialization phase of the sheet feeding device, the drive motor 9 is rotated in the one direction (direction A in FIG. 1), so that the bellows 4 is shrunk in its axial direction by the urging force from the movable bracket 11 until the movable bracket 11 abuts the stop projection 12. Therefore, air within the bellows is discharged therefrom through the joints 4*a*, 4*b*, the tubular member 5*a*,5*b* and the suction cups 1*a*, 1*b*.

Thereafter, the movable member 3 is moved downwardly so that the sheet sensor 2 becomes contact with the uppermost sheet 6 at which the sensor 2 is rendered ON. In this case, the suction cups la and lb are also in contact with the uppermost sheet 6. In response to the ON signal, the downward movement of the movable member 3 is stopped, and the drive motor 9 is rotated in the opposite direction (direction B in FIG. 1) by a predetermined rotation numbers. As a result, a negative pressure is generated within spaces defined by the bellows 4, the flexible tubular members 5*a*, 5*b* and the suction cups 1*a*, 1*b*, and accordingly, the uppermost sheet 6 is attracted to the suction cups 1*a* and 1*b*. Then, the movable member 3 is moved upwardly so as to direct the attracted sheet 6 toward the sheet feed path (not shown).

In the fundamental construction, both ends of the bellows 4 are provided with joints 4*a* and 4*b*, and these are in fluid communication with the suction cups 1*a*, 1*b* via the flexible tubular members 5*a*, 5*b*. However, the ends of the bellows 4 can be provided integral with the tubular members without using the joint members.

In the suction type sheet feeding device according to the fundamental construction, the bellows is used, as one of the components of the negative pressure generating unit, which is expandable and contractible to suck in air and blow the air, and which has accordionlike walls allowing one to vary the volume. Since the bellows is employed for generating the negative pressure instead of the conventional piston/cylinder arrangement, Numbers of mechanical components can be reduced, and high dimensional accuracy is not required. Furthermore, both ends of the bellows can be connected to the suction cups, and therefore, intricate joint members are not required or connecting the negative pressure generating means to the suction cups. Accordingly, resultant sheet feeding device can have a simple construction for facilitating assembly at low cost, and further, the probability of misoperation or faulty operation of the negative pressure generation unit can be reduced.

Figure 2:
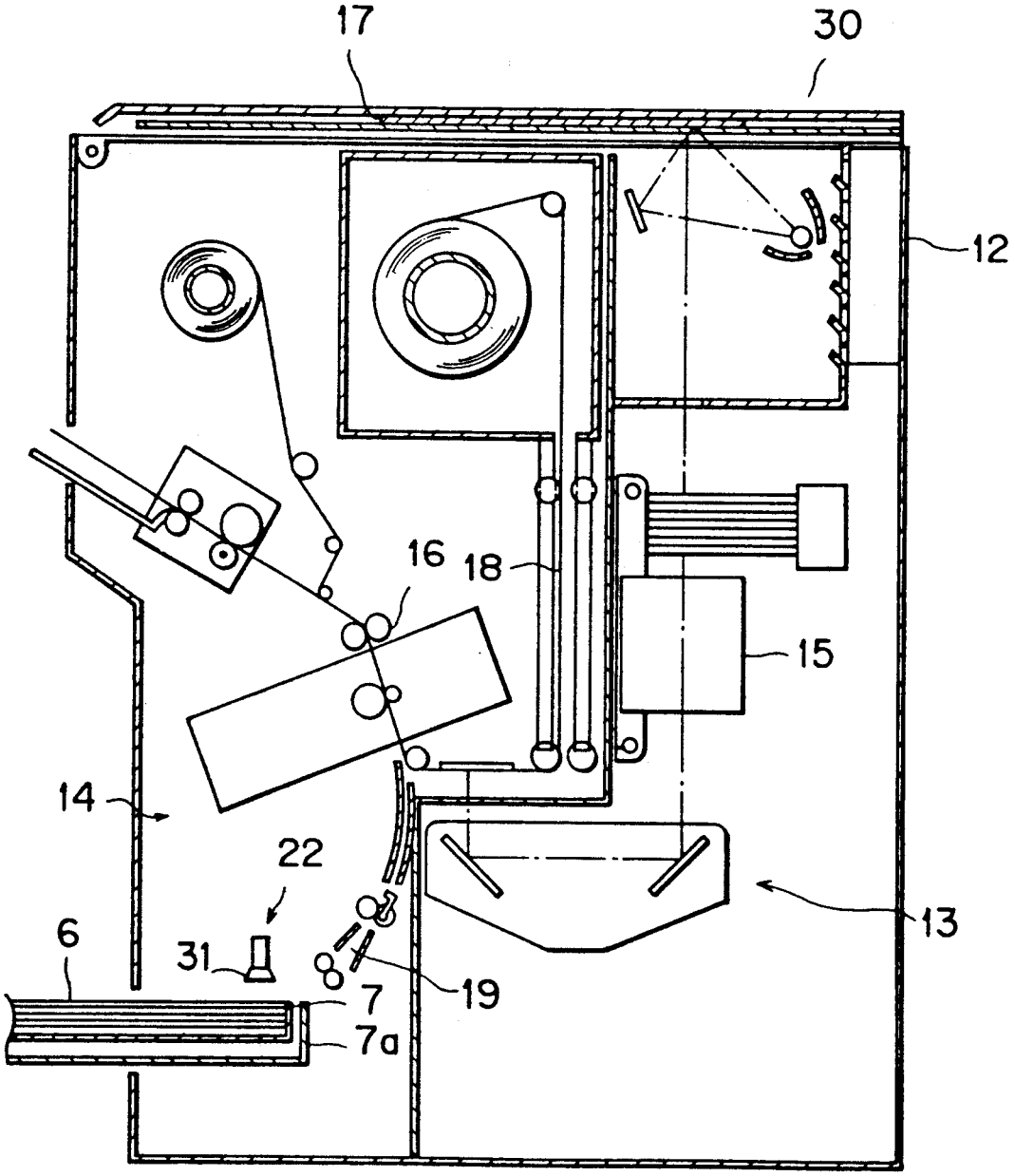
FIG. 2 is a schematic cross-sectional view showing an image recording apparatus incorporating the suction type sheet feeding device according to the present invention.

Next, before entering into a substantive description of a detailed arrangement of a suction type sheet feeding device provided with the bellows type suction unit, an image recording apparatus will be described first with reference to FIG. 2. The image recording apparatus incorporates therein the sheet feeding device according to the present invention.

Figure 3:
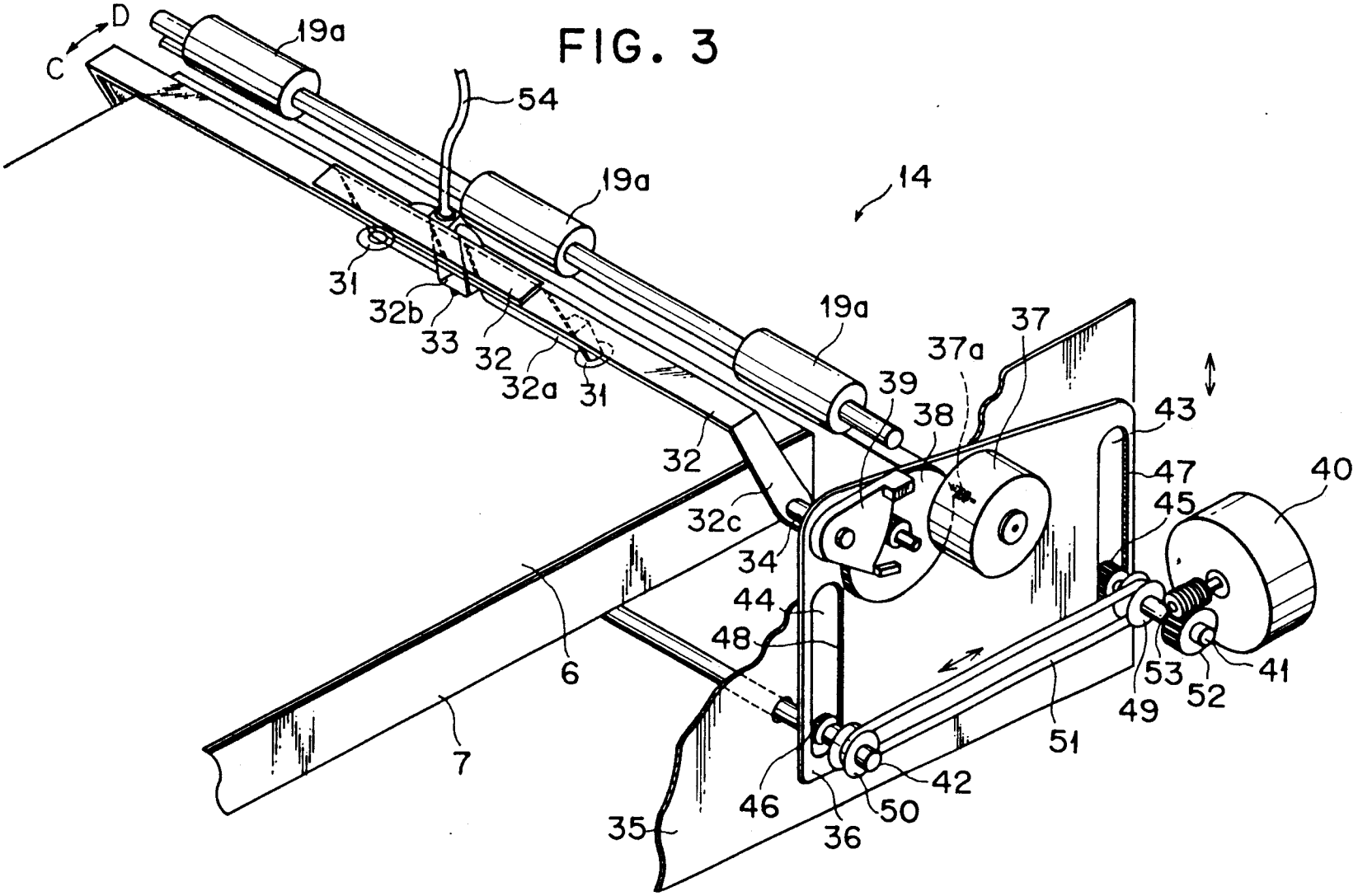
FIG. 3 is a perspective view showing a sheet feeding device according to one embodiment of the present invention.
Figure 4:
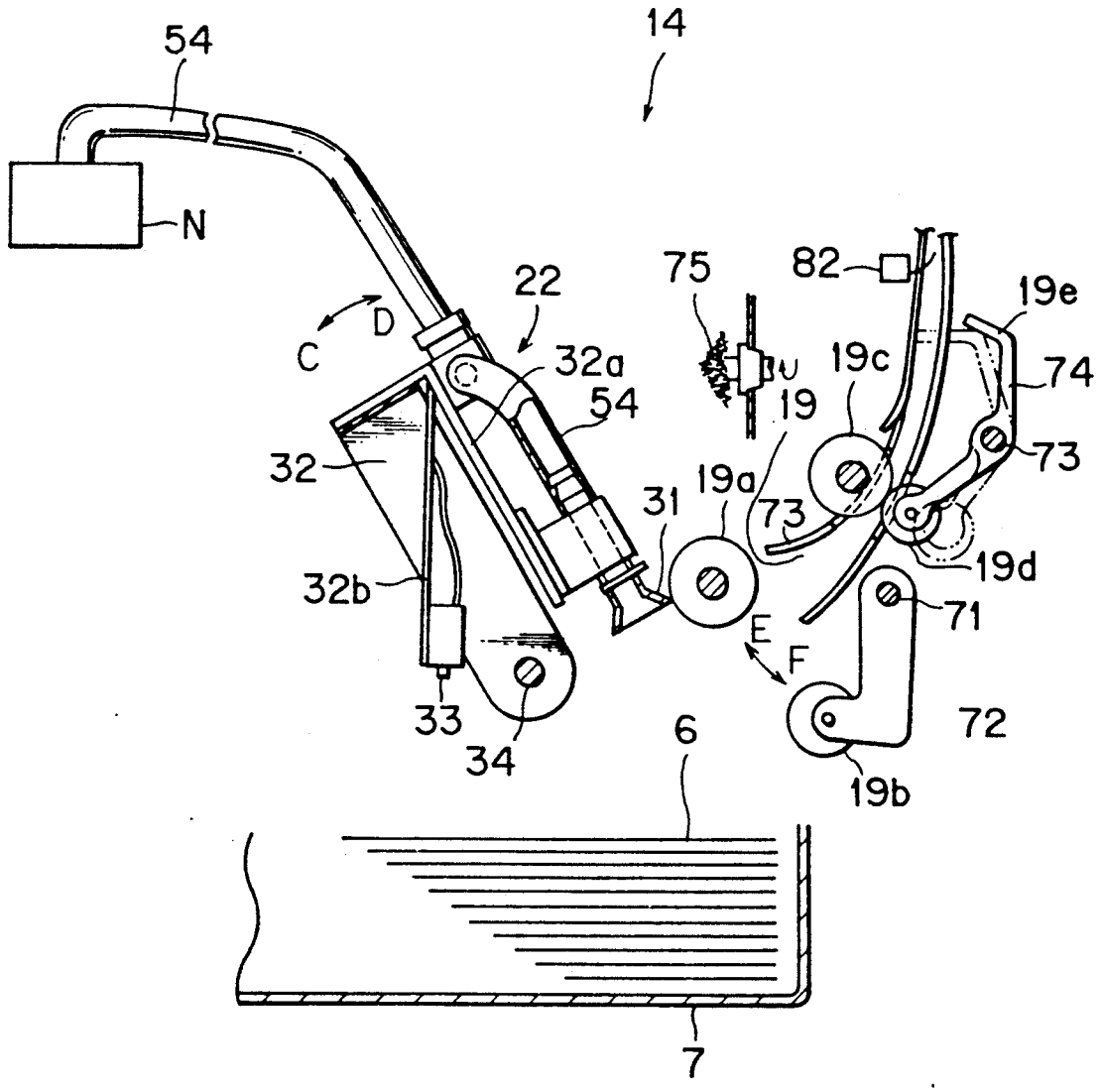
FIG. 4 is a cross-sectional view showing the suction type sheet feeding device having its rest position according to the embodiment.
Figure 5:
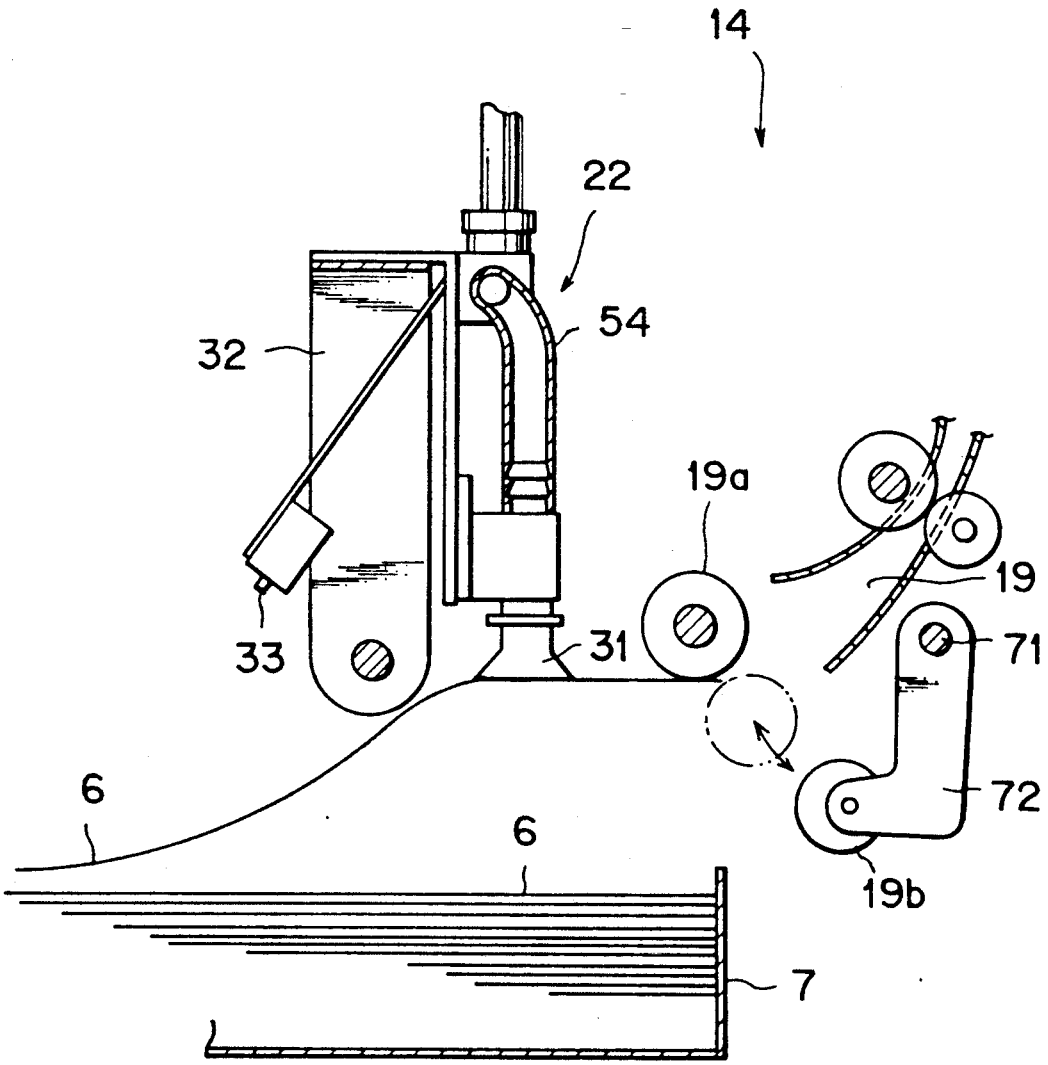
FIG. 5 is a cross-sectional view showing a sheet attraction phase of the suction type sheet feeding device according to the embodiment of this invention.
Figure 6:
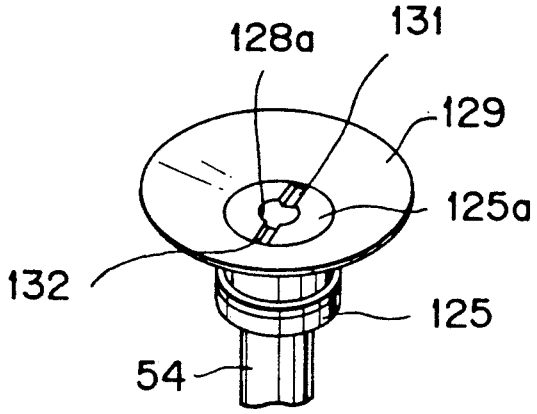
FIG. 6 is a perspective view showing a suction cup unit of the sheet feeding device according to the embodiment of this invention.

An image recording apparatus 30 has an outer frame 12 in which a copying mechanism 13 and a sheet feeding device 14 are provided. The copying mechanism 13 generally includes an exposure unit 15 and a developing unit 16. In the exposure unit 15, an elongated microcapsule sheet 18 is exposed to an image light from an original 17 for forming a latent image corresponding to the original image on the microcapsule sheet 18. On the other hand, a sheet 6 such as a developer sheet is fed from a sheet cassette 7 positioned in a cassette casing 7*a* to the developing unit 16 through a sheet path 19 by a suction cup unit 22 of the sheet feeding device 14, and the latent image on the microcapsule sheet 18 is transferred to the sheet 6 at the developing unit 16. Then, the sheet 6 carrying an output image thereon is discharged to an outside.

a Detailed arrangement of a suction type sheet feeding device provided with the bellows type negative pressure generation unit will be described with reference to FIGS. 3 through 5. The sheet feeding device 14 generally includes the negative pressure generating unit N having at least one suction cup for absorbing a sheet under the negative pressure, a sheet delivery means for delivering the attracted sheet to a predetermined sheet path (see 19 in FIG. 2), moving means for moving the suction cup unit 22 so as to transfer the sheet to the sheet delivery means, and a cleaning means for cleaning an attraction surface of the suction cup. Further, in the illustrated embodiment, cleaning to the suction cup is carried out after a predetermined number of sheet feedings, to thereby provide stabilized sheet feeding operations with reduced entire sheet feeding period. In FIGS. 3 through 5, the sheet delivery means, the moving means and the cleaning means are particularly shown.

As described above with reference to FIG. 2, the sheet cassette 7 storing therein the stack of cut sheets 6 is positioned within the frame 12. On the frame, the moving means, the sheet delivery means and the cleaning means are supported.

Referring first to the moving means, as best shown n FIG. 3, the frame 12 has confronting stationary side walls 35, and an elevation frame 36 is vertically movably supported in parallel with the side walls 35 by guide members (not shown). In FIG. 3, only one of the side walls 35 is delineated for simplicity. The elevation frame 36 is formed with a pair of vertically oriented elongates slots 43 and 44 in which vertically oriented races 47 and 48 are formed, respectively. Further, a pair of horizontally extending shafts 41 and 42 are rotatably supported about their axes by the side walls 35, 35, and these shafts 41 and 42 extend through the elongated slots 43, 44, respectively, These shafts 41, 42 are fixedly mounted with gears 45 and 46 meshedly engageable with the racks 47 and 48, respectively. Pulleys 49, 50 are fixedly mounted on end portions of the shafts 41, 42 and a timing belt 51 is mounted on the pulleys 49, 50. Furthermore, a helical ear 52 is fixedly mounted on an distal end portion of the shaft 41, and a stepper motor 40 is mounted on the side wall 35. The steeper motor 40 has an output shaft to which a worm gear 53 is mounted. The worm gear 53 is meshingly engageable with the helical gear 52. Therefore, the elevation frame 36 is movable in the vertical direction relative to the side walls 35 upon energization of the stepper motor 40. The elevation frame 36 is finally connected to suction cups 31, 31 as described later, so that the suction ups 31, 31 are also movable in the vertical direction in accordance with the vertical motion of the elevation frame 36.

A pivotally movable arm 32 horizontally extends above the sheet cassette 7. The movable arm 32 has bent portions **32*c* bent by 90 degrees with respect to the horizontally extending portion thereof, and ends of the ben portion 32*a* are joined to a rotation shaft 34. The rotation shaft 34 is rotatably supported by the elevation frame 36, and is fixedly mounted with a sector gear 39. Further, a gear set 38 is rotatably supported on the elevation frame 36 and is engageable with the sector gear 39. Furthermore, a reversible gear 37 is mounted on the elevation frame 36 having a motor gear 37*a*. The motor gear 37*a* is meshedly engageable with the gear set 38. Therefore, upon rotation of the motor 37, the sector gear 39 is angularly rotated about an axis of the rotation shaft 34, so that the pivotally movable arm 32 is pivotally moved about the axis of the shaft 34 in directions indicated by arrows C and D in FIG. 3. The suction cups 31, 31 are supported to the movable arm 32, and therefore, the suction cups 31 31 are pivotally movable as well as vertically movable at a position above the sheet cassette 7**.

As shown in FIGS. 3 and 4, the suction cups 31, 31 are supported to the pivotally movable arm 32 by an attachment plate **32*a*. In this case, the suction cups 31, 31 are attached to the movable arm 32 in such a manner that the axis of the rotation shaft 34 is in alignment with sucking surfaces or free edgelines of the suction cups 31, 31. Further, the rotation shaft 34 is positioned behind the suction cups 31, 31 with respect to sheet feeding direction. That is, the rotation shaft 34 is positioned upstream of the suction cups 31. Furthermore, the suction cups 31 31 is positioned so a to absorb a sheet portion adjacent to the leading edge of the sheet 6** with respect to the sheet feeding direction.

A second attachment plate **32*b* is branched from the first attachment plate 32*a* at a predetermined angle for attaching a sheet sensor 33 such as a microswitch. In this case, the sheet sensor 33 and the rotation shaft 34 can be positioned on a same horizontal plane, when the second attachment plate 32*b* is directed in the vertical direction as shown in FIG. 4. The suction cups 31, 31 are connected to the negative pressure generation unit N shown in FIG. 1 through a flexible tubular member 54. The negative pressure generation unit N may be mounted on the side wall confronting the side wall 35 of FIG. 2**.

Next, the sheet delivery means will be described with reference to FIGS. 4 and 5. At the sheet feed path 19 (also shown in FIG, 2), a feed roller **19*a* is provided rotatable about a stationary axis at a position above the leading edge portion of the uppermost sheet 6. Further, a pinch roller 19*b* is rotatably supported to a pivot arm 72 pivotally supported by the side wall 35 (not shown in FIG. 4) by a pivot shaft 71. The pivot arm 72 is driven by a drive source (not shown). Therefore, the pinch roller 19*b* is movable toward and away from the feed roller 19*a* in directions indicated by arrows E and F in FIG. 4 by the pivot motion of the pivot arm 72**.

Further, a guide member 73 is provided at a position downstream of the feed roller **19*a* for defining the sheet path 19, and a stationary roller 19*c* and a movable roller 19*d* are also provided at the sheet path defined by the guide member 73. The movable roller 19*d* is rotatably supported at one end of a lever 74 whose another end is provided with a resist gate 19*e*. The lever 74 has an intermediate portion rotatably supported by the side wall by a shaft 73. When the movable roller 19*d* is moved toward the stationary roller 19*a*, the resist gate 19*e* positioned at downstream of the movable roller 19*d* opens the sheet path as shown by a solid line in FIG. 4. On the other hand, when the movable roller 19*d* is moved away from the stationary roller 19*c*, the resist gate 19*e* closes the sheet path for regulating a leading edge position of the sheet 6. Incidentally, a sheet counter 82 is provided so as to detect the numbers of sheets fed along the sheet path 19**.

In the illustrated embodiment, the cleaning means is further provided for cleaning the interior surface of the suction cups 31 at a proper timing. The cleaning means has a cleaning pad 75 having conical configuration. The cleaning pad 75 may be rotatable about its axis for efficient cleaning of the suction cup interior. The movable arm 32 can have an ascent cleaning position so that the suction cup 31 can be brought into contact with the cleaning pad 75 along with the pivotal movement of the suction cup unit 22 toward the cleaning pad 75.

Next details of the suction cup unit 22 will be described with reference to FIGS. 6 through 9. The suction cup unit 22 includes a suction pipe 125 and a flexible suction disc 139. The suction pipe 125 is formed of a plastic material and has a circular cross section. The suction pipe 125 has one end portion connected to the flexible tubular member 54 and has another end portion having an increased diameter for providing an enlarged area surface or a suction face 125*a* at its tip end adapted for facing against the uppermost sheet 6. It goes without saying that the flexible tubular member 54 is connected to the bellows type negative pressure generation unit shown in FIG. 1. In the suction pipe 125, a suction hole 128 is defined, and a suction port 128*a* is defined at the enlarged area surface 125*a*. At the enlarged area surface 125*a*, a pair of grooves 131 are formed which extend in radial direction of the pipe 125 and at positions at diametrically opposite sides thereof. Inner ends of the grooves 121 are connected to the suction port 128*a*, and outer ends of the grooves 121 extend to an outer circumference of the enlarged area portion.

Figure 9:
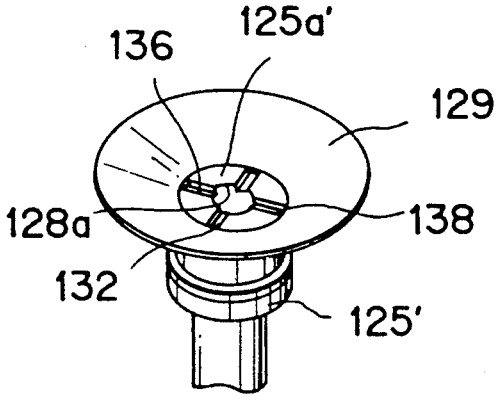
FIG. 9 is a perspective view showing a suction cup unit according to one modified embodiment of this invention.

In one modification, as shown in FIG. 9, four grooves 131, 132, 136, 138 are formed on an suction face 125*a*' of a suction pipe 125' at equi-angular space (at every 90 degrees).

The flexible suction disc 129 is fitted with the one end portion of the suction pipe 125. The suction disc 129 is formed of a flexible material such as rubber, and has a frusto-conical shape with an increasing inner diameter toward its circumference. Therefore, during sucking operation, an inner area of the flexible suction disc 129 is in intimate contact with the uppermost sheet 6 because of its elastic deformation, and the sheet 6 is attracted by the negative force applied through the suction hole 128 and the suction port 128*a*.

Operation of the sheet feeding device will be described.

Figure 7:
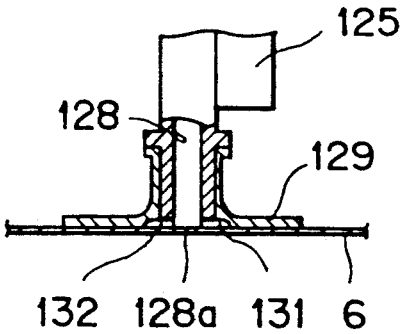
FIG. 7 is a cross-sectional view showing the suction cup unit in its normal sheet contacting fashion according to the embodiment of this invention.

The sheet feeding device 14 has a rest position shown in FIG. 4. If a start key is manipulated, the movable arm 32 is pivotally moved about the shaft 34 so that the suction pipe 125 is directed in the vertical direction. At the same time, the movable arm 32 is moved downwardly in accordance with the downward movement of the elevation frame 36. Therefore, the suction disc 129 and the suction face 125*a* (125*a*') of the suction pipe 125 of the suction cup unit 22 are brought into contact with the uppermost sheet 6 as shown in FIG. 7. In this case, the sheet sensor 33 is also in contact with the uppermost sheet 6, and therefore, the downward movement of the suction cup unit 22 is stopped. Then, the negative pressure generation unit N is actuated to produce the negative pressure within the suction cup unit 22. Accordingly, the uppermost sheet 6 is attracted to the suction disc 129.

Figure 8:
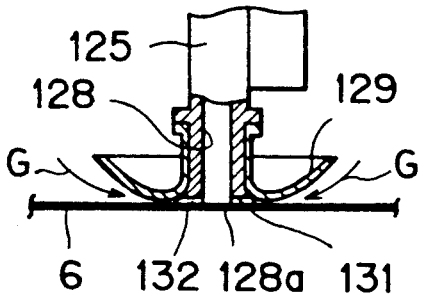
FIG. 8 is a cross-sectional view showing the suction cup unit in its abnormal sheet contacting fashion according to the embodiment.

Here, when the suction disc 129 is in contact with the uppermost sheet 6, the disc 129 may be excessively distorted as shown in FIG. 8 due to a change in material quality attendant to long term use. If such popping deformation cannot be recovered, only the suction face 125*a* of the suction pipe 125 is in contact with the sheet 5, which in turn lowers the sheet attraction force. Consequently sheet either cannot be lifted or the sheet attracted to the suction face 125*a* may be released therefrom during its travel to the sheet delivery means. Such a drawback may be overcome by enlarging the diameter of the suction disc 129. However, in the image recording apparatus, bulky disc 129 may be unavailable due to spacial limitation. In the illustrated embodiment, such drawbacks can be eliminated because of the formation of the grooves 131, 132 (and 136, 138) formed on the suction face 125*a* (125*a*') of the suction pipe 125 (125').

That is, even if the suction disc 129 is inadvertently deformed, when the suction face 125*a* (125*a*') is in intimate contact with the sheet 6, air between the popping suction disc 129 and the sheet 6 can be sucked into the suction pipe 125 though these grooves 131, 132 as indicated by an arrow G shown in FIG. 8. This air flow urges the upwardly deformed suction disc 129 toward the downward direction, and therefore, the suction disc 129 can restore its original shape as shown in FIG. 7. As a result, sufficient suction force can be obtained for attracting the sheet 6 to the suction unit 22.

Then, the suction cup unit 22 is lifted upwardly in accordance with the upward movement of the elevation frame 36 as shown in FIG. 5. In this case, the pinch roller 19*b* is positioned spaced away from the feed roller 19*a* as shown by the solid line in FIG. 5. Therefore, the leading edge portion of the attracted and lifted sheet 6 can be positioned immediately below the feed roller 19*a*. Thereafter, the pinch roller 19*b* is moved toward the feed roller 19*a* for nipping the leading edge portion of the sheet 6 therebetween. Then, the evacuation force is released, so that the sheet 6 is separable from the suction cup unit 22, and at the same time, the feed roller 19*a* is rotated for feeding the sheet to the pressure developing unit 16 through the sheet feed path 19. Accordingly, the output image can be formed on the sheet 6 at the pressure developing unit 16.

Figure 10:
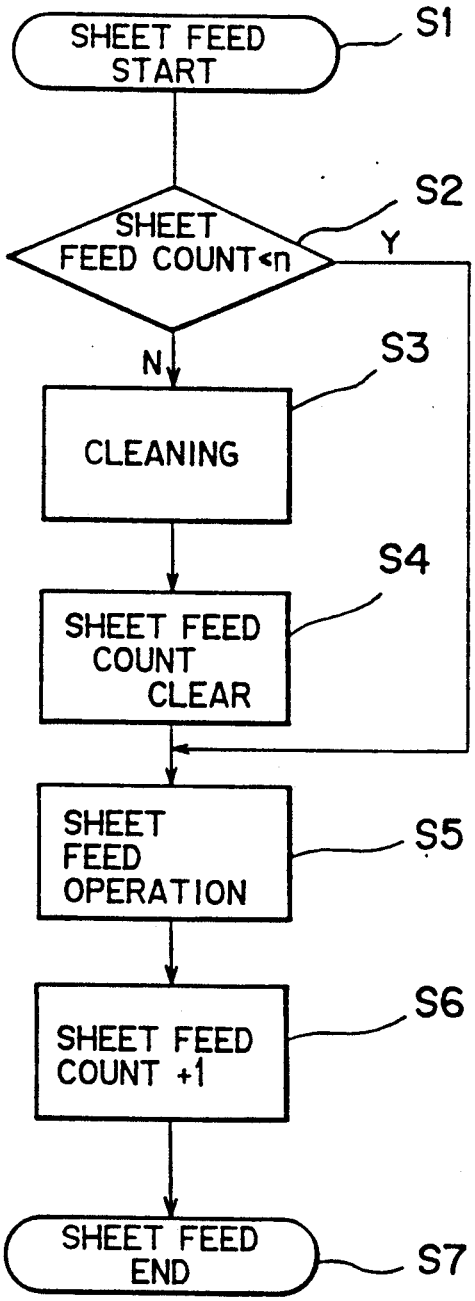
FIG. 10 is a flow chart for description of sheet feeding and cleaning sequence with respect to the suction cup unit according to the embodiment of this invention.

In this manner, the sheet feeding operation is repeatedly carried out for repeatedly forming the output images on the sheets 6. That is, as shown in FIG. 10, in step S1, the sheet feed start switch is rendered ON, and the number of sheets 6 fed along the sheet path 19 is counted by the sheet counter 82. In step S2, if the count value is less than the predetermined number "n", the sheet feeding operations are repeated in Step S5, and the sheet number is incremented by +1 in Step S6 upon every passing of the sheet 6 through the sheet detector 82. On the other hand, in Step S2, if the count value exceeds th predetermined number, a suction cup cleaning operation if performed in step S3, and the sheet counting operation is cleared in Step S4. In the sheet cleaning operation, the movable arm 32 is elevated, and is pivotally moved. Therefore, the suction cup is brought into pressure contact with the cleaning pad 75. Then, the cleaning pad 75 is rotated about its axis for cleaning th pad interior, i.e., the internal surface of the suction disc 129 and the suction face 125*a* . When the cleaning operation is completed, the routine proceeds into an ordinary sheet feeding operation in Step S5, and in Step S7, the sheet feeding operation is terminated. In order to execute such routines, a conventional microcomputer is available as a control means which is connected to the drive sources 9, 37, 40, etc. through an interface. The microcomputer installs a nonvolatile memory for storing therein the sheet count value.

As described above, in the suction type sheet feeding deice of the present invention, since the bellows is employed for generating the negative pressure instead of the conventional piston/cylinder arrangement, number of mechanical components can be reduced, and high dimensional accuracy is not required which has been required in the conventional piston/cylinder type sliding relationship. Furthermore, both ends of the bellows can be connected to the suction cups, and therefore, the conventional intricate joint members are not required for connecting the negative pressure generating means to the suction cups. Accordingly, the resultant sheet feeding device can have a simple construction that facilitates low cost assembly, further the provability of misoperation or faulty operation of the negative pressure generation unit can be reduced.

In the illustrated embodiment, because the suction cup undergoes cleaning by the cleaning means, misoperation of the sheet feeding can be reduced for a long duration of use. Furthermore, the cleaning is not performed after every sheet is fed but is performed after number of sheets have been fed. Thus, the overall copying operation can be carried out with minimal dead period. Therefore, the entire copying period is not significantly prolonged by the cleaning operation.

Moreover, even if the suction disc is popping deformed at the time of direct contact with the sheet and the substantive contacting are relative to the sheet is reduced, the suction disc can be promptly restored to its original shape because of the air suction force through the grooves formed in the suction face of the suction pipe. Accordingly, sufficient sheet attraction can be provided and a large suction disc is not required to avoid the accidental popping deformation.

In the above described embodiment, the suction type sheet feeding device is applied to an image recording apparatus. However, the suction type sheet feeding device is available for various types of equipment within the spirit and scope of the present invention.

What is claimed is:

1. A sheet feeding device for feeding an uppermost sheet of a sheet stack to a predetermined position comprising:

at least one suction cup unit movable toward and away from the uppermost sheet for attracting the uppermost sheet;

a moving means mounting thereon said at least one suction cup unit for moving said at least one suction cup unit toward the uppermost sheet and toward the predetermined position;

a negative pressure generating unit connected to said at least one suction cup unit for generating a negative pressure within at least one suction cup comprising said at least one suction cup unit, the negative pressure generation unit comprising a bellows shrinkable and expandable in its axial direction, and drive means for selectively providing the shrinkage and expansion of the bellows, wherein said bellows has a first and a second end and said at least one suction cup unit comprises tow suction cups to which the uppermost sheet is attracted and the sheet feeding device further comprises two flexible tubulary members each having a first end connected to a respective one of the first and second end of the bellows and a second end connected to one of the suction cups.

2. The sheet feeding device as claimed in claim 1, wherein the drive means comprises;

a stationary bracket fixedly supporting the one end of the bellows;

a movable bracket fixedly supporting the another end of the bellows;

a sector gear operably connected to the movable bracket;

a drive motor operably connected to the sector gear for moving the movable bracket in one and opposite directions whereby the negative pressure is generated within the suction cups.

3. The sheet feeding device as claimed in claim 1, further comprising a sheet delivery means for feeding the attracted uppermost sheet transferred by the moving means to the predetermined position, the predetermined position being a sheet feed path.

4. The sheet feeding device as claimed in claim 1; wherein the suction cup unit comprises;

a flexible suction disc adapted for contacting the uppermost sheet, the suction disc having a frusto-conical configuration with an increasing inner diameter toward its circumference; and a suction pipe formed with a suction hole and a suction port at a tip end of the suction hole, the suction pipe having one ned portion fitted with the suction disc, and another end portion, the one end portion having a free end face defining a suction face and formed with at least one groove whose one end is opened to the suction port and whose another end is opened to an outer circumference of the suction pipe.

5. The sheet feeding device as claimed in claim 4, wherein the suction cup unit further comprises a flexible tubular member having one end connected to the another end portion of the suction pipe and having another end connected to the negative pressure generation unit.

6. The sheet feeding device as claimed in claim 5, wherein to grooves are formed on the suction face of the suction pipe in a diametrically opposite side thereof.

7. The sheet feeding device as claimed in claim 5, wherein four grooves are radially formed on the suction face of the suction pipe at an equal angular space.

8. A sheet feeding device for feeding an uppermost sheet of a sheet stack to a predetermined position, comprising:

at least one suction cup unit movable toward and away from the uppermost sheet for attracting the uppermost sheet;

a moving means mounting thereon said at least one suction cup unit for moving said at least one suction cup unit toward the uppermost sheet and toward the predetermined position;

a negative pressure generating unit connected to said at least one suction cup unit for generating a negative pressure within at least one suction cup comprising said at least one suction cup unit, the negative pressure generation unit comprising a bellows shrinkable and expandable in it s axial direction;

a drive means for selectively providing the shrinkage and expansion of the bellows;

a sheet delivery means for feeding the attracted uppermost sheet transferred by the moving means to the predetermined position, the predetermined position being a sheet feed path;

cleaning means for cleaning the suction cup, and control means connected to the moving means, the delivery means and the drive means for cleaning the suction cup after a predetermined number of sheet feeding operations given by the moving means, the delivery means and the drive means, the control means comprising a microprocessor provided with a memory for storing therein numbers of sheets fed through the sheet feed path.

9. A sheet feeding device for feeding an uppermost sheet of a sheet stack to a predetermined position, comprising:

at least one suction cup unit movable toward and away from the uppermost sheet for attracting the uppermost sheet, the at least one suction cup unit comprising a flexible suction disc adapted for contacting the uppermost sheet, the suction disc having a frusto-conical configuration with an increasing inner diameter toward its circumference and a suction pipe formed with a suction hole and a suction port at a tip end of the suction hole, the suction pipe having one ned portion fitted with the suction disc, and another end portion, the one end portion having a free end face defining a suction face and formed with at least one groove whose one end is opened to the suction port and whose another end is opened to an outer circumference of the suction pipe;

moving means mounting thereon the at least one suction cup unit for moving the at least one suction cup unit toward the uppermost sheet and toward the predetermined position;

a first drive means connected to the moving means for driving the moving means;

a negative pressure generating unit connected to the at least one suction cup unit for generating a negative pressure within at least one suction cup unit, the negative pressure generating unit comprising a bellows shrinkable and expandable in its axial direction; and a second drive means connected to the negative pressure generating unit for selectively providing the shrinkage and expansion of the bellows, the second drive means being operative independent of the first drive means.

* * * * *